US010391339B2

(12) United States Patent
Sun

(10) Patent No.: US 10,391,339 B2
(45) Date of Patent: Aug. 27, 2019

(54) FALL PROTECTION DEVICE

(71) Applicant: YOKE INDUSTRIAL CORP., Taichung (TW)

(72) Inventor: Eason Sun, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 23 days.

(21) Appl. No.: 15/873,451

(22) Filed: Jan. 17, 2018

(65) Prior Publication Data

US 2019/0083826 A1 Mar. 21, 2019

(30) Foreign Application Priority Data

Sep. 20, 2017 (TW) ..... 106132319 A

(51) Int. Cl.
*A62B 35/00* (2006.01)
*A62B 1/10* (2006.01)

(52) U.S. Cl.
CPC ..... *A62B 35/0093* (2013.01); *A62B 1/10* (2013.01)

(58) Field of Classification Search
CPC .... F16D 55/24; F16D 65/122; F16D 69/0408; A62B 35/0093; A62B 1/10
USPC ..... 188/65.1, 65.2, 65.4; 267/197, 198; 242/419.9; 254/378, 391
See application file for complete search history.

(56) References Cited

U.S. PATENT DOCUMENTS 8,181,744 B2 * 5/2012 Parker ..... A62B 1/10 182/232
9,121,462 B2 9/2015 Casebolt
9,861,841 B1 * 1/2018 Hung ..... A62B 35/0093
2018/0289987 A1 * 10/2018 Hung ..... A62B 1/14
2018/0333598 A1 * 11/2018 Hung ..... A62B 35/0075
(Continued)

FOREIGN PATENT DOCUMENTS

TW M404024 U 5/2011
TW M450390 U 4/2013
(Continued)

OTHER PUBLICATIONS

Examination Report for TW106132319, dated May 23, 2018, Total of 2 pages.
(Continued)

*Primary Examiner* — Pamela Rodriguez
(74) *Attorney, Agent, or Firm* — Lynette Wylie; Apex Juris, pllc.

(57) ABSTRACT

A fall protection device includes a frame, a rotation unit, a safety belt, a braking plate, a braking block and a restoring spring. The frame includes a first lateral plate, and a stopping block is formed on an exterior surface of the first lateral plate. The rotation unit is rotatably disposed with the frame. The safety belt is wound around the rotation unit. The braking plate is engaged with the rotation unit and includes an interior surface which faces the exterior surface of the first lateral plate. The braking block is pivotally disposed on the braking plate and located between the interior surface of the braking plate and the exterior surface of the first lateral plate. The present invention could ensure the braking block to abut against the stopping block as the braking block is at an expanding position, and thereby to improve a reliability of the lockup function.

9 Claims, 11 Drawing Sheets

(56) References Cited

U.S. PATENT DOCUMENTS

2019/0030381 A1* 1/2019 Hung ..... A62B 35/0037

FOREIGN PATENT DOCUMENTS

| | | |
|---|---|---|
| TW | M529524 U | 10/2016 |
| TW | M555231 U | 2/2018 |

OTHER PUBLICATIONS

Search Report for TW106132319, dated May 23, 2018, Total of 1 page.
English Abstract for TWM404024, Total of 1 page.
English Abstract for TWM450390, Total of 1 page.
English Abstract for TWM529524, Total of 1 page.
English Abstract for TWM555231, Total of 1 page.

* cited by examiner

FALL PROTECTION DEVICE

BACKGROUND OF THE INVENTION

1. Technical Field

The present invention is related to a fall protection device, and more particularly related to a fall protection device which is adapted for use in hoisting operation workplace.

2. Description of Related Art

Workers usually wear a fall protection device including a safety belt when they work in elevated workplaces; the safety belt is attached to the worker and the fall protection device is secured to a support. If the worker falls accidentally, the fall protection device and the safety belt are able to prevent the worker from continuing to fall so as to ensure the safety of the worker.

As shown in FIG. 1, a conventional fall protection device 1 includes a housing 10, a frame 12 disposed in the housing 10, a rotation unit 14, a safety belt 16, a rewinding unit 18, a braking plate 20 and two braking blocks 22. Wherein, the housing 10 is constituted by two housing parts 102 which are joined to each other. The frame 12 includes a first lateral plate 122 and a second lateral plate 124 which face each other. The rotation unit 14 is rotatably disposed between the first lateral plate 122 and the second lateral plate 124, wherein a stopping block 122*a* is formed on the first lateral plate 122. The safety belt 16 is wound around the rotation unit 14. The rewinding unit 18 is disposed at an exterior side of the second lateral plate 124 which includes a spiral spring 182 connected to the rotation unit 14, and is adapted to provide a force to rewind the safety belt 16. The braking plate 20 is disposed at an exterior side of the first lateral plate 122, and is engaged with the rotation unit 14 so as to be rotated with the rotation unit 14. The braking plate 20 has an exterior surface 202 which is opposite to the first lateral plate 122. The braking block 22 is disposed on the exterior surface 202 of the braking plate 20 and is pivotally connected to a pivot 202*a* formed on the exterior surface 202 wherein the braking block 22 is located between the housing 10 and the first lateral plate 122. When the braking plate 20 rotates, the braking block 22 would be thrown out from a closed position to an expanding position by centrifugal force to abut against the stopping block 122*a* and thereby to restrict the rotation of the rotation unit 14.

Referring to FIG. 2, if the worker falls accidentally from the elevated workplace, the braking block 22 would pivotally swing to the expanding position to abut against the stopping block 122*a* on the first lateral plate 122 via a stopping part 222 formed thereon under normal condition, thereby enabling an immediate brake to stop the rotation of the rotation unit 14 so as to prevent the worker from continuing to fall.

Though, the fall protection devices 1 are usually used in dusty environments such that a pivoted portion of the braking block 22 is probably adhered by dust which makes the braking block 22 be stuck with the pivot 202*a*. Dust adhesions on the pivoted portion of the braking block 22 may cause the braking block 22 to be unable to be thrown out in emergency situations, resulting the lockup function to fail. Therefore, the pivoted portion between the braking block 22 and the braking plate 20 could be designed to have a loose fit to prevent the braking block 22 from being stuck by dust particles.

However, the loose-fit design would have a possibility that the braking block 22 swings toward a direction away from the exterior surface 202 of the braking plate 20 (as shown in FIG. 3). Especially if assembling tolerances resulting an interval between the housing 10 and the exterior surface 202 of the braking plate 20 become too large, it is possible that the stopping part 222 of the braking block 22 would not be stopped by the stopping block 122*a* and the lockup function fails.

BRIEF SUMMARY OF THE INVENTION

In view of the above, the present invention is to provide a fall protection device which could improve a reliability of the lockup function.

To achieve the object mentioned above, the present invention provides a fall protection device, including a frame, a rotation unit, a safety belt, a braking plate, a braking block and a restoring spring. Wherein, the frame includes a first lateral plate and a second lateral plate which face each other. The first lateral plate includes an exterior surface which faces toward a direction away from the second lateral plate. A stopping block is formed on the exterior surface. The rotation unit is rotatably disposed between the first lateral plate and the second lateral plate of the frame. The safety belt is wound around the rotation unit and disposed between the first lateral plate and the second lateral plate. The safety belt is adapted to be pulled to drive the rotation unit to rotate. The braking plate is engaged with the rotation unit and includes an interior surface which faces the exterior surface of the first lateral plate. The braking block is pivotally disposed on the interior surface of the braking plate and located between the interior surface of the braking plate and the exterior surface of the first lateral plate. The braking block includes a stopping part which could pivotally swing from a closed position to an expanding position by centrifugal force to abut against the stopping block as the braking plate rotates and thereby to restrict the rotation of the rotation unit. The restoring spring is connected between the braking block and the braking plate to drive the braking block to move back to the closed position.

The advantage of the present invention is that by restricting the position of the braking block by the first lateral plate and the braking plate, it could ensure the braking block at the expanding position to abut against the stopping block, and could prevent the situation that a braking block of a conventional fall protection device swings but misses a stopping block as the braking block is at an expanding position, which could improve a reliability of the lockup function of the fall protection device.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
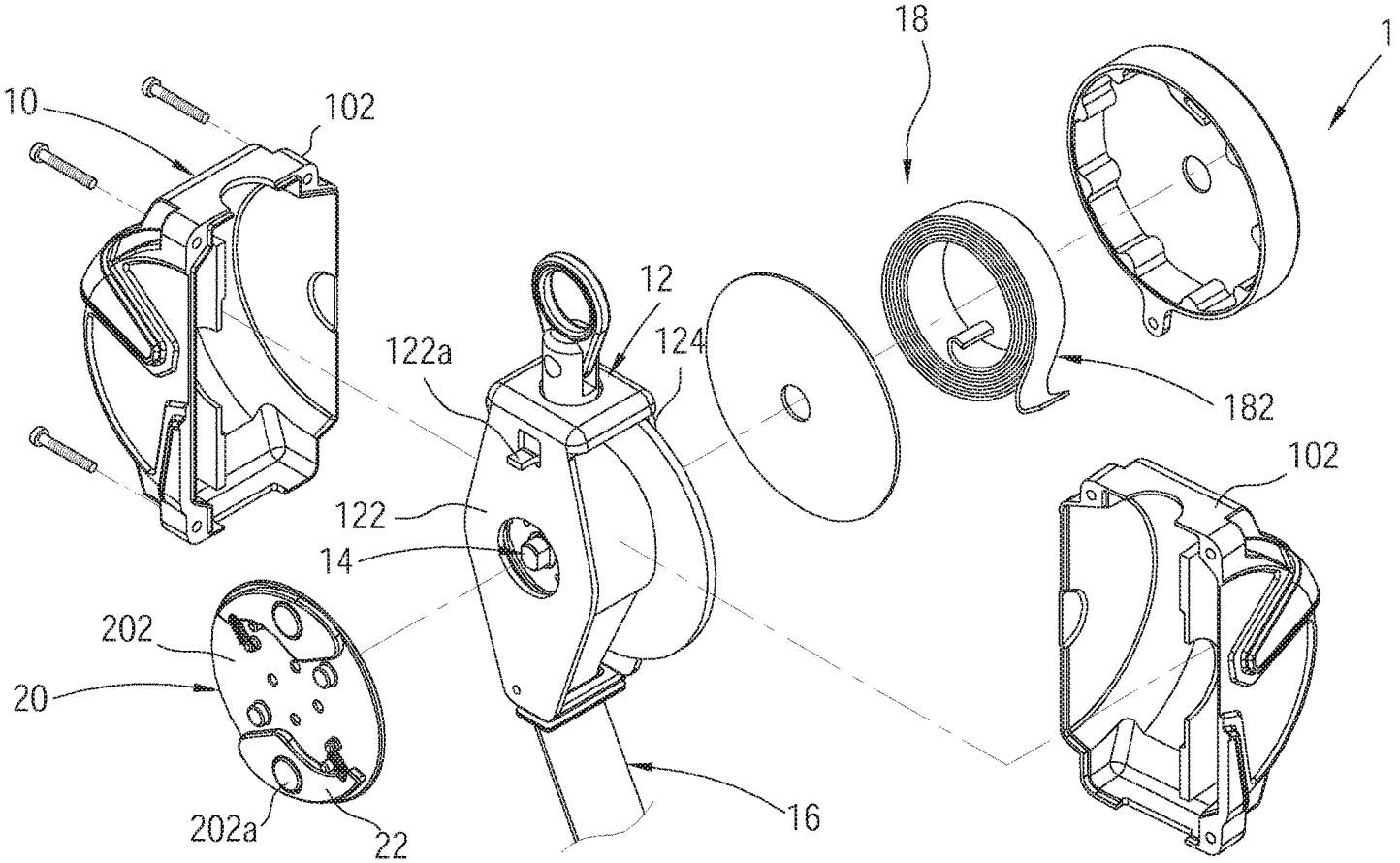
FIG. 1 (PRIOR ART)
FIG. 1 is an exploded perspective view of a conventional fall protection device.
Figure 3:
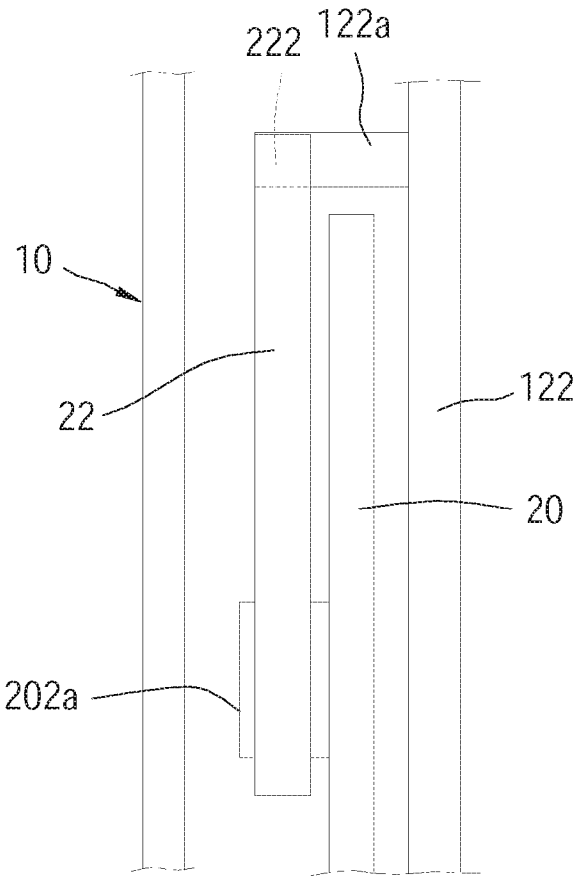
FIG.3 (PRIOR ART)
FIG. 3 is a schematic view showing that a stopping part of a braking block deviates from a normal position and is unable to abut against a stopping block.
Figure 2:
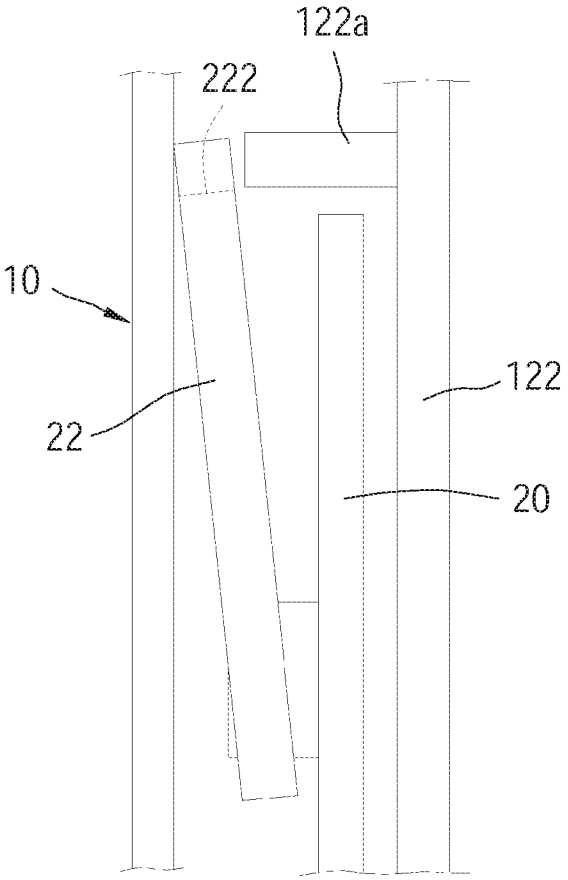
FIG.2 (PRIOR ART)
FIG. 2 is a schematic view showing a stopping part of a braking block abutting against a stopping block.
Figure 4:
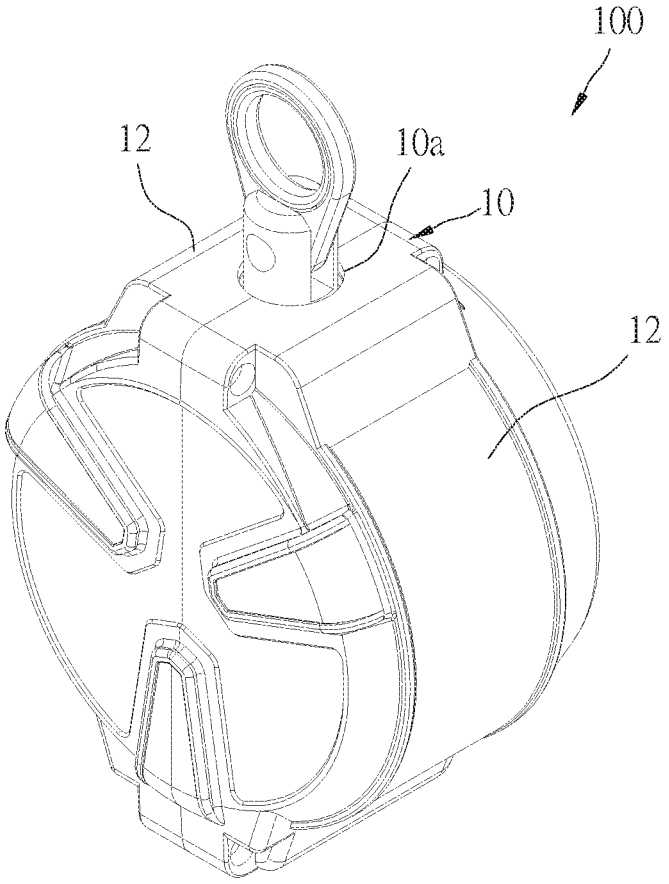
FIG. 4 is a perspective view of a fall protection device of an embodiment according to the present invention.
Figure 5:
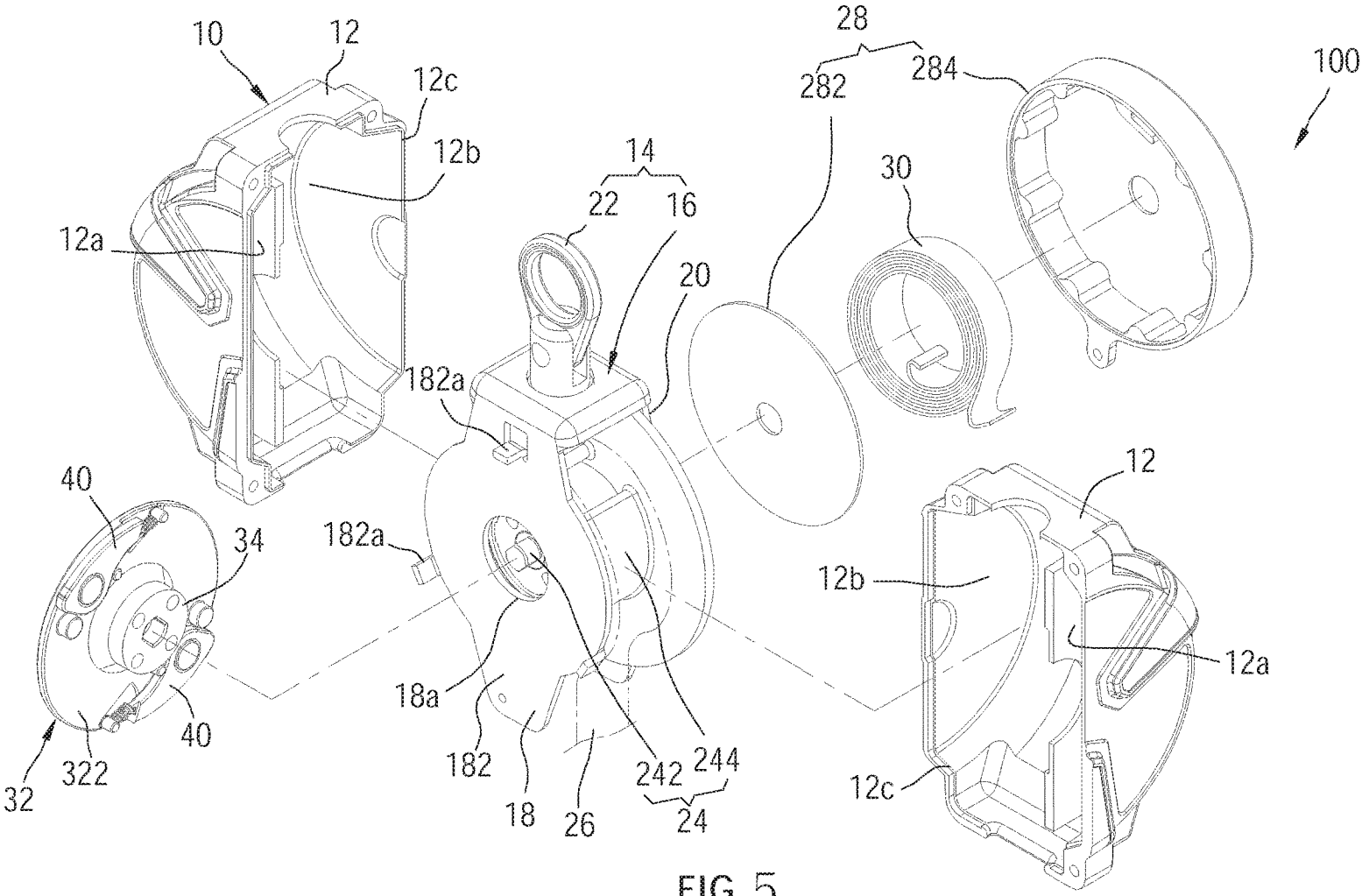
FIG. 5 is an exploded view of the fall protection device of FIG. 4.
Figure 6:
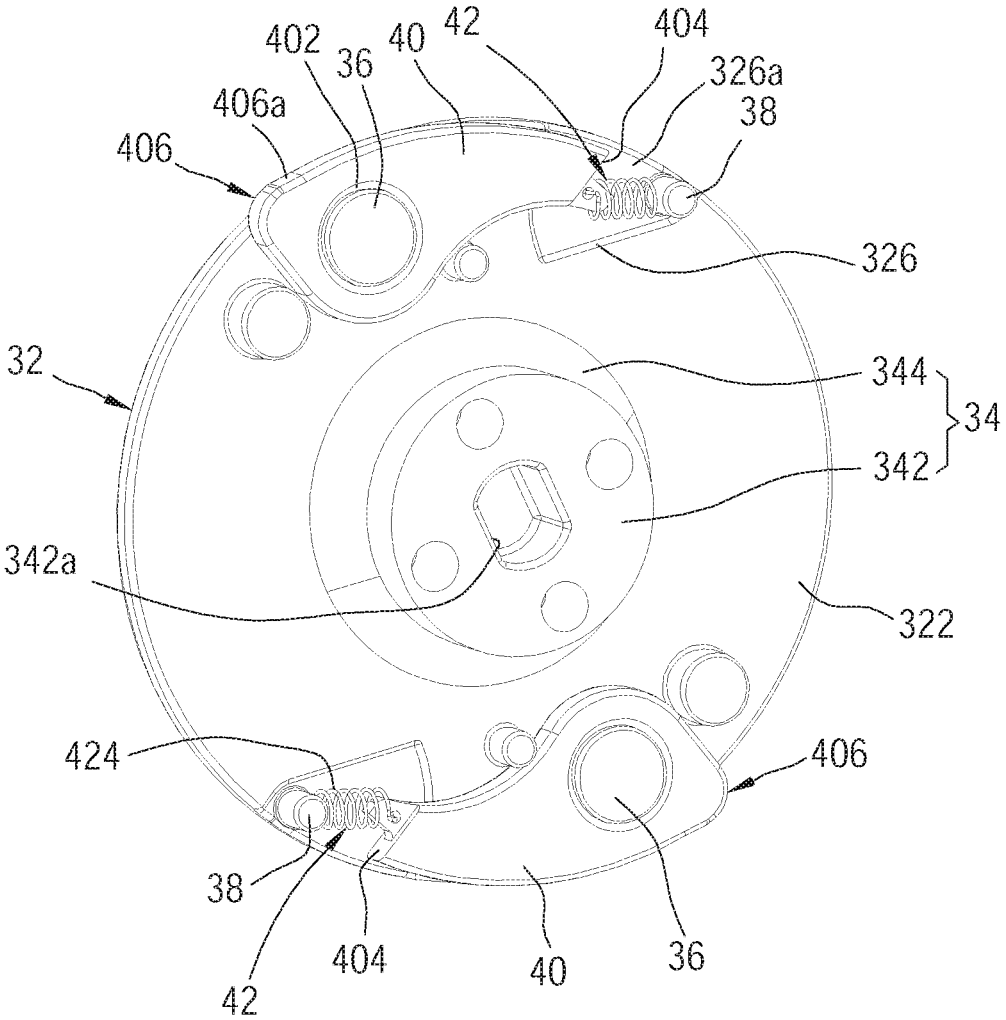
FIG. 6 is a perspective view of a braking plate and a braking block of the fall protection device of FIG. 4.

The following illustrative embodiments and drawings are provided to illustrate the disclosure of the present invention, these and other advantages and effects can be clearly understood by persons skilled in the art after reading the disclosure of this specification. As shown in FIG. 4 to FIG. 9, a fall protection device 100 of an embodiment according to the present invention includes a housing 10, a frame 14 disposed in the housing 10, a rotation unit 24, a safety belt 26, a casing 28, a spiral spring 30, a braking plate 32, at least one braking block 40 and at least one restoring spring 42.

The housing 10 is constituted by two housing parts 12 which are joined to each other. Each of the two housing parts 12 includes a first chamber 12*a*, a second chamber 12*b*, and an opening 12*c*, wherein the first chamber 12*a* and the second chamber 12*b* are separated to each other. The two housing parts 12 are joined to each other through the opening 12*c*. The housing 10 includes an upper hole 10*a* and a lower hole (not shown).

The frame 14 includes a frame body 16 and a hanging ring 22 connected to a top of the frame body 16. The frame body 16 includes a first lateral plate 18 and a second lateral plate 20 which face each other. The first lateral plate 18 is disposed in the first chambers 12*a* of the two housing parts 12 and the second lateral plate 20 is disposed in the second chambers 12*b* of the two housing parts 12. The first lateral plate 18 includes an exterior surface 182 which faces toward a direction away from the second lateral plate 20. At least one stopping block 182*a* is formed on the exterior surface 182. In this embodiment, three stopping blocks 182*a* are formed on the exterior surface 182. The first lateral plate 18 includes a through hole 18*a*. The hanging ring 22 penetrates through the upper hole 10*a* of the housing 10 and extends outwardly.

The rotation unit 24 is rotatably disposed between the first lateral plate 18 and the second lateral plate 20 of the frame body 16 and includes a shaft 242 and a rotary drum 244, wherein each of two ends of the shaft 242 penetrates through the through hole 18*a* of the first lateral plate 18 and the second lateral plate 20 of the frame 14 respectively. The rotary drum 244 is disposed on the shaft 242 and rotated with the shaft 242 coaxially. A part of the rotary drum 244 is exposed by the through hole 18*a*.

The safety belt 26 is wound around the rotation unit 24 and disposed between the first lateral plate 18 and the second lateral plate 20. More particularly in this embodiment, one end of the safety belt 26 is connected to the rotary drum 244 to be wound around the rotary drum 244 and another end of the safety belt 26 penetrates through the lower hole of the housing 10. The safety belt 26 is adapted to be pulled to drive the rotary drum 244 and the shaft 242 to rotate.

The casing 28 is disposed in the second chambers 12*b* of the two housing parts 12 and connected to the second lateral plate 20 of the frame 14. The casing 28 includes a first cover 282 and a second cover 284. The spiral spring 30 is disposed between the first cover 282 and the second cover 284. An interior end of the spiral spring 30 is connected to the rotation unit 24, and an exterior end of the spiral spring 30 is connected to the casing 28.

The braking plate 32 is engaged with the rotation unit 24 and includes an interior surface 322 which faces the exterior surface 182 of the first lateral plate 18. The braking plate 32 is rotated with the rotation unit 24 coaxially. In this embodiment, the braking plate 32 is disk-shaped and a central part of the interior surface 322 protrudes to form a convex axle 34. Wherein, the convex axle 34 includes a first section 342 and a second section 344 which are connected to each other. The first section 342 is equal-diameter, penetrating the through hole 18*a* of the first lateral plate 18 to be engaged with the rotary drum 244 of the rotation unit 24, and includes an axle hole 342*a* adapted to be inserted by the shaft 242. The second section 344 is tapered and has an external diameter which is gradually increased from the first section 342 to the interior surface 322 so as to improve the strength of the braking plate 32 and minimize the interference between the braking plate 32 and the first lateral plate 18 as the braking plate 32 rotates. Moreover, the interior surface 322 of the braking plate 32 is disposed with at least one pivot 36 and at least one fixing post 38. In this embodiment, the interior surface 322 of the braking plate 32 is disposed with two pivots 36 and two fixing posts 38, wherein on two opposite sides of the convex axle 34 are disposed with one of the two pivots 36 and one of the two fixing posts 38.

The interior surface 322 of the braking plate 32 has a surface 324, which is concave and at least one recess 326 is formed thereon. In this embodiment, two recesses 326 are formed on the surface 324. One end of each of the two fixing posts 38 is connected to an inner surface 326*a* of the recess 326 and protrudes out of the recess 326.

Figure 10:
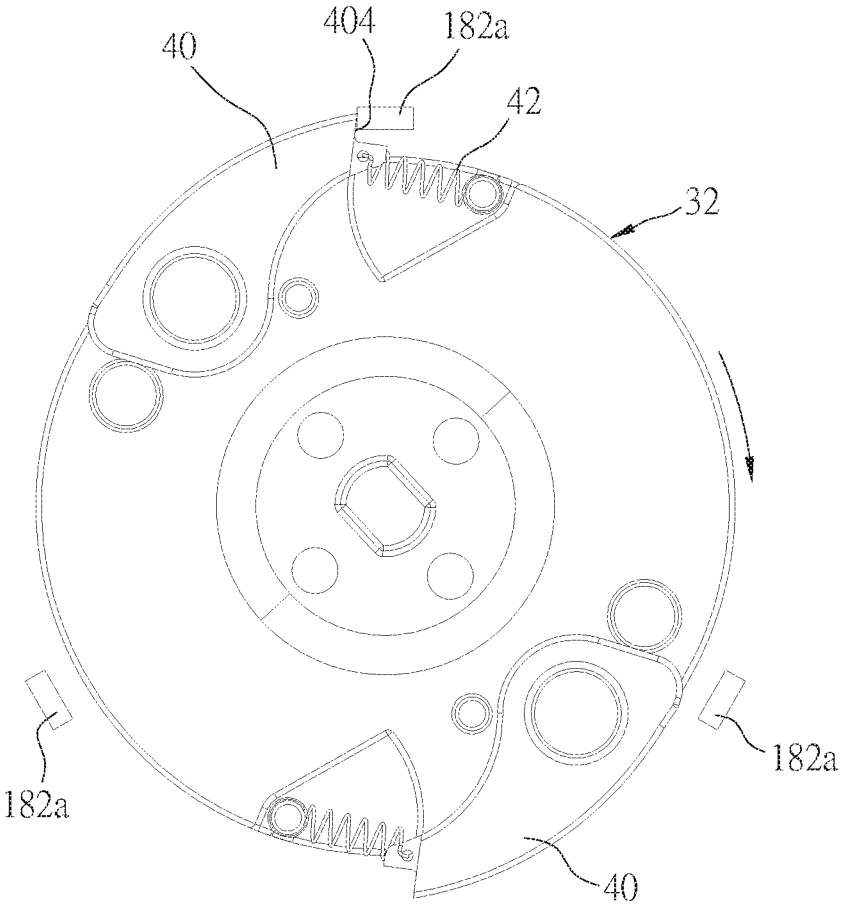
FIG. 10 is a schematic view showing a braking block being at an expanding position and abutting against a stopping block.
Figure 11:
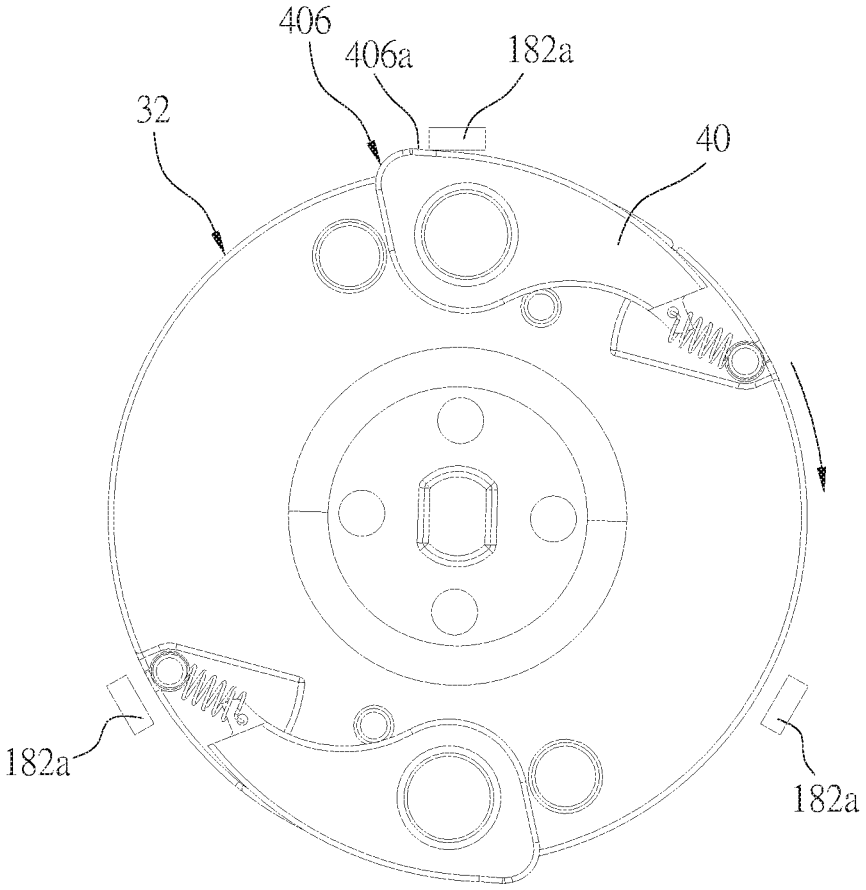
FIG. 11 is a schematic view showing the braking block being at a closed position and passing the stopping block on the rotation.

In this embodiment, the fall protection device 100 includes two braking blocks 40. Each of the two braking blocks 40 includes a pivoting hole 402. A hole diameter of the pivoting hole 402 is greater than an external diameter of the pivot 36 of the braking plate 32. The braking block 40 is disposed on the interior surface 322 of the braking plate 32 and is pivotally connected to the pivot 36 formed on the interior surface 322 via the pivoting hole 402 wherein the braking block 40 is located between the interior surface 322 of the braking plate 32 and the exterior surface 182 of the first lateral plate 18. The pivoting hole 402 of the braking block 40 has a loose fit on the pivot 36 which could prevent the pivot 36 from being stuck when dust particles enter the pivoting hole 402. The braking block 40 could pivotally swing between an expanding position (as shown in FIG. 10) and a closed position (as shown in FIG. 11). Each of the two braking blocks 40 includes a stopping part 404 which would be thrown out to the expanding position by centrifugal force to abut against the stopping block 182*a* as the braking plate 32 rotates and thereby to restrict the rotation of the rotation unit 24.

Figure 7:
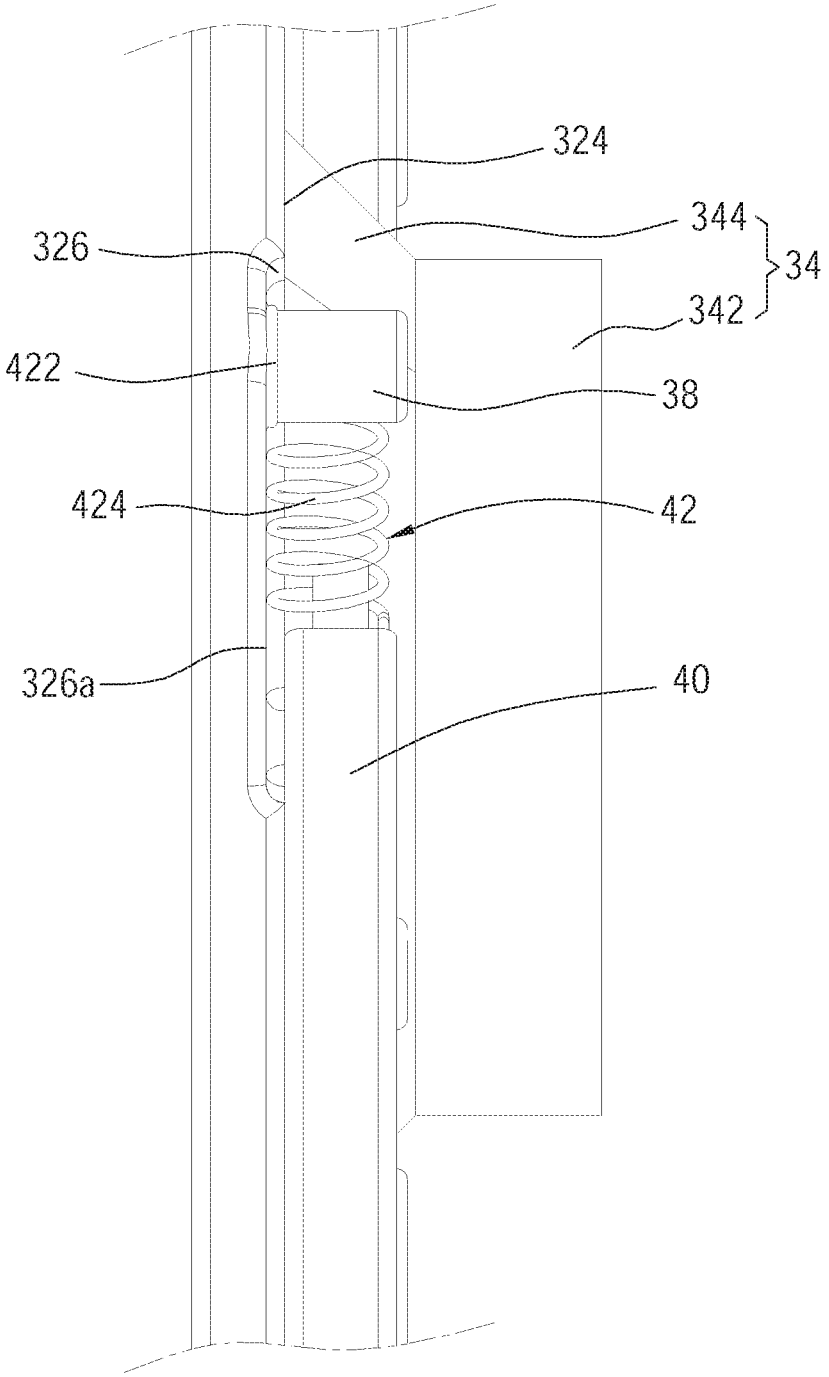
FIG. 7 is a partial side view of the fall protection device of FIG. 5.
Figure 8:
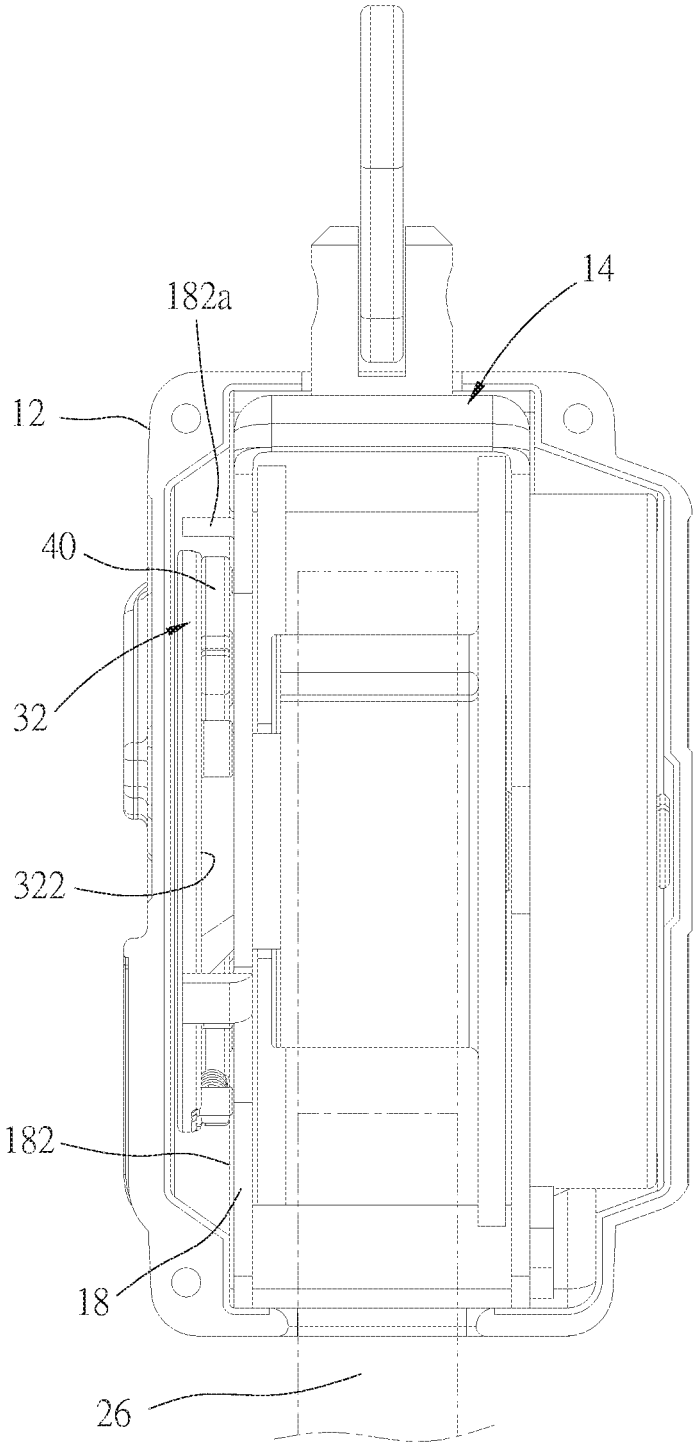
FIG. 8 is a side view of the fall protection device of FIG. 5 as viewed from one side of a first housing part of the fall protection device, wherein a view of a second housing part of the fall protection device is hidden behind.
Figure 9:
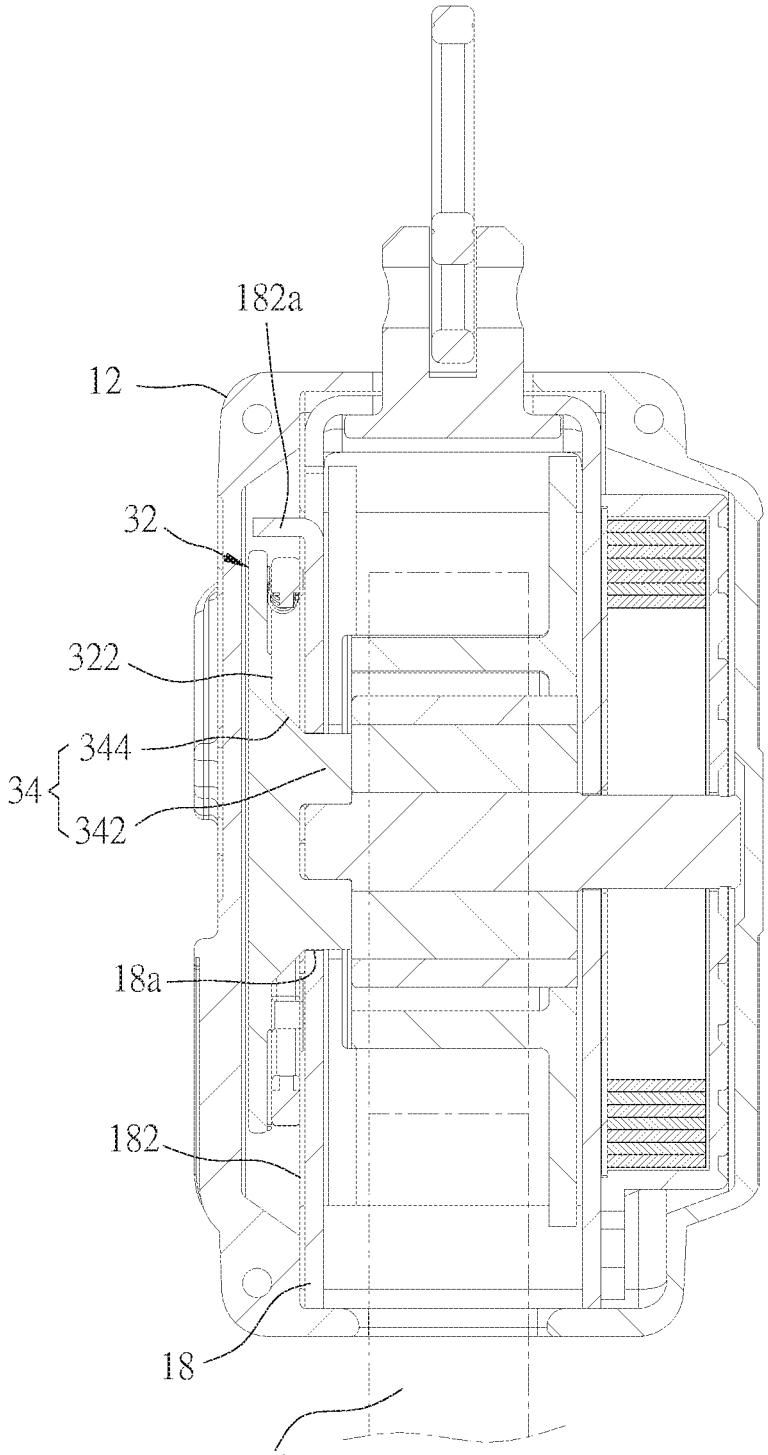
FIG. 9 is a cross-sectional view of the fall protection device of FIG. 8.

The restoring spring 42 is connected between the braking block 40 and the braking plate 32 to drive the braking block 40 to move back to the closed position such that the stopping part 404 of the braking block 40 would be located within the periphery of the braking plate 32 under normal condition. In this embodiment, the fall protection device 100 includes two restoring springs 42. One end of each of the two restoring springs 42 is connected to each of the two braking blocks 40 respectively and is located adjacent to each of the stopping parts 404. Another end of each of the two restoring springs 42 has a ring 422 which is tied to the fixing post 38 and disposed between the surface 324 of the braking plate 32 and the inner surface 326*a* of the recess 326 respectively (as shown in FIG. 7), which makes the restoring spring 42 be adjacent to the surface 324 of the braking plate 32 to keep the braking block 40 be adjacent to the surface 324 of the braking plate 32. Each of the two restoring springs 42 has a torso 424, which could produce elastic force, and part of the torso 424 of the restoring spring 42 protrudes into the recess 326. When the braking block 40 is at the closed position, the restoring spring 42 is in a range of orthographic projection of the recess 326. The design of the recess 326 which receives a part of the torso 424 could prevent the restoring spring 42 from pushing the braking block 40 away from the surface 324, resulting the first lateral plate 18 to be rubbed by the braking block 40.

When a user attached with the safety belt 26 falls accidentally, the safety belt 26 is pulled rapidly to drive the rotation unit 24 and the braking plate 32 to rotate quickly so as to produce centrifugal force. The braking blocks 40 are driven by centrifugal force to overcome the elastic force of the restoring spring 42, and thrown out to abut against the stopping block 182*a* and thereby to restrict the rotation of the rotation unit 24. Such that a pulled-out length of the safety belt 26 could be fixed to prevent the user from continuing to fall.

It is worth mentioning that by restricting the position of the braking block 40 by the first lateral plate 18 and the braking plate 32, it could ensure the stopping part 404 to abut against the stopping block 182*a* as the braking block 40 is at the expanding position and could prevent the situation that a braking block of a conventional fall protection device swings but misses a stopping block as the braking block is at an expanding position.

Accidents would occur if the braking blocks 40 are not able to pivotally swing because a pivoted portion between the braking blocks 40 and the braking plate 32 is stuck by small objects like dust particles. Therefore, the present invention further provides a structure for the braking blocks 40 which would be described in detail as follows.

Figure 12:
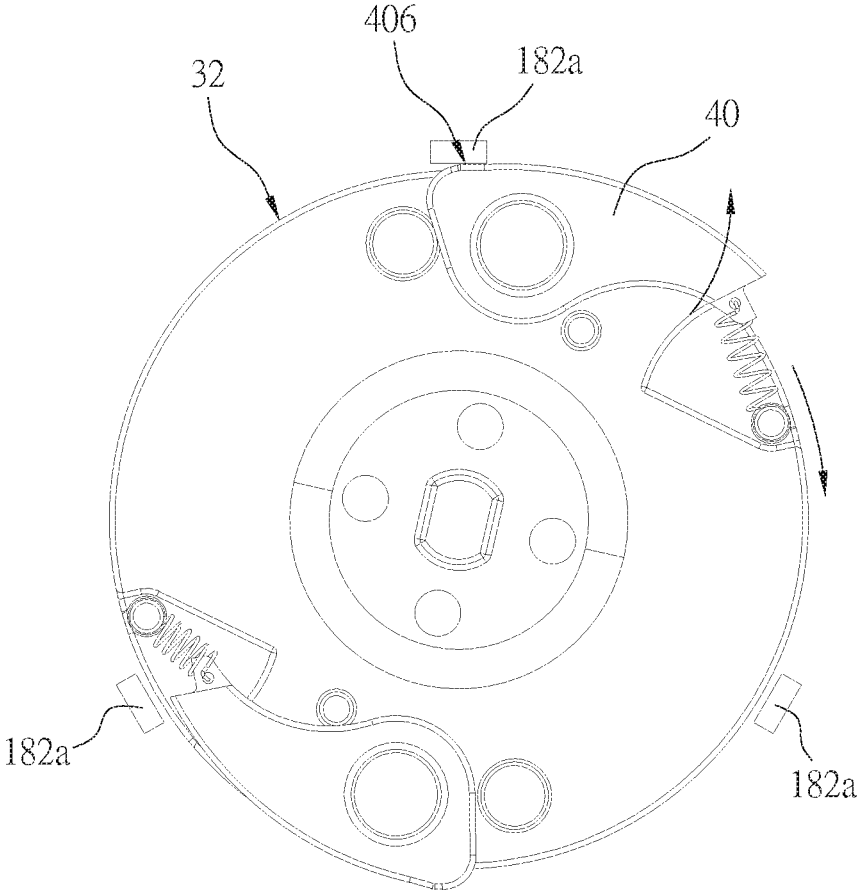
FIG. 12 is a schematic view showing the braking block being forced to pivotally swing outwardly by abutting against the stopping block via an abutting part thereof.

The braking block 40 further includes an abutting part 406. The abutting part 406 and the stopping part 404 are disposed on two opposite sides of the pivoting hole 402, respectively. The abutting part 406 is rotated with the braking plate 32 and moves along a moving path. The stopping block 182*a* is located on the moving path of the abutting part 406. In this embodiment, an outer edge 406*a* of the abutting part 406 protrudes in a direction away from the pivoting hole 402 and exceeds the periphery of the braking plate 32. When the abutting part 406 passes the stopping block 182*a* and is abutted against by the stopping block 182*a*, the braking block 40 would pivotally swing from the closed position (as shown in FIG. 11) outwardly (as shown in FIG. 12).

Whereby, the user can pull the safety belt 26 in advance to check the vibrations produced by the swing of the braking block 40 and confirm the fall protection device 100 operates normally. It is worth to mention that when the braking block 40 is locked and unable to pivotally swing, the abutting part 406 of the braking block 40 would abut against the stopping block 182*a* to restrict the rotation of the rotation unit 24 so as to prevent the user from continuing to fall. Those are protections brought from the fall protection device 100.

It must be pointed out that the embodiments described above are only some embodiments of the present invention. All equivalent structures which employ the concepts disclosed in this specification and the appended claims should fall within the scope of the present invention.

What is claimed is:

1. A fall protection device, comprising:

a frame, including a first lateral plate and a second lateral plate which face each other, wherein the first lateral plate includes an exterior surface which faces toward a direction away from the second lateral plate, and a stopping block is formed on the exterior surface;

a rotation unit, rotatably disposed between the first lateral plate and the second lateral plate of the frame;

a safety belt, wound around the rotation unit and disposed between the first lateral plate and the second lateral plate; the safety belt is adapted to be pulled to drive the rotation unit to rotate;

a braking plate, engaged with the rotation unit and including an interior surface which faces the exterior surface of the first lateral plate;

a braking block, pivotally disposed on the interior surface of the braking plate and located between the interior surface of the braking plate and the exterior surface of the first lateral plate; the braking block includes a stopping part which would pivotally swing from a closed position to an expanding position by centrifugal force to abut against the stopping block as the braking plate rotates and thereby restrict the rotation of the rotation unit; and a restoring spring, connected between the braking block and the braking plate to drive the braking block to move back to the closed position.

2. The fall protection device of claim 1, wherein a pivot is disposed on the interior surface of the braking plate; the braking block includes a pivoting hole to be engaged with the pivot; a diameter of the pivot is smaller than a hole diameter of the pivoting hole.

3. The fall protection device of claim 2, wherein the braking block includes an abutting part; the abutting part and the stopping part are disposed on two opposite sides of the pivoting hole, respectively; the abutting part is rotated with the braking plate and moves along a moving path; the stopping block is located on the moving path of the abutting part; when the abutting part passes the stopping block to be abutted against the stopping block, the braking block would be forced to swing pivotally.

4. The fall protection device of claim 3, wherein the braking plate further has a periphery; an outer edge of the abutting part protrudes in a direction away from the pivoting hole and exceeds the periphery; the abutting part passes the stopping block via the outer edge and is abutted against the stopping block.

5. The fall protection device of claim 1, wherein a fixing post is disposed on the interior surface of the braking plate; one end of the restoring spring is connected to the braking block and located adjacent to the stopping part, and another end of the restoring spring has a ring which is tied to the fixing post.

6. The fall protection device of claim 5, wherein a recess is disposed on the interior surface; the restoring spring has a torso; part of the torso of the restoring spring protrudes into the recess.

7. The fall protection device of claim 6, wherein the interior surface has a surface; the recess is concave into the surface; one end of the fixing post is connected to an inner surface of the recess; the ring of the restoring spring is disposed between the surface and the inner surface of the recess.

8. The fall protection device of claim 7, wherein when the braking block is at the closed position, the restoring spring is within an orthographic projection of the recess.

9. The fall protection device of claim 1, wherein the first lateral plate of the frame includes a through hole; the interior surface of the braking plate is disposed with a convex axle including a first section and a second section which are connected to each other; by inserting the first section through the through hole of the first lateral plate, the convex axle is engaged with the rotation unit; an external diameter of the second section is gradually increased from the first section to the interior surface.

* * * * *